US006760057B2

(12) United States Patent
Hayakawa et al.

(10) Patent No.: US 6,760,057 B2
(45) Date of Patent: Jul. 6, 2004

(54) OPTICAL RECORDING METHOD, APPARATUS, SYSTEM AND MEDIUM USING HIGH-POWER LASER LIGHT

(75) Inventors: Toshiro Hayakawa, Ebina (JP); Nobufumi Mori, Ooi-machi (JP); Yoji Okazaki, Odawara (JP); Hiroyuki Hiiro, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 58 days.

(21) Appl. No.: 10/144,863

(22) Filed: May 15, 2002

(65) Prior Publication Data

US 2002/0126200 A1 Sep. 12, 2002

Related U.S. Application Data

(63) Continuation-in-part of application No. 09/848,325, filed on May 4, 2001, now abandoned.

(30) Foreign Application Priority Data

May 17, 2001 (JP) ..... 2001-147254

(51) Int. Cl.[7] ..... G03C 1/00
(52) U.S. Cl. ..... 347/252
(58) Field of Search ..... 367/262; 347/264, 347/241, 232, 239, 240, 267, 251, 252, 254, 255

(56) References Cited

U.S. PATENT DOCUMENTS 4,285,056 A * 8/1981 Bell ..... 347/264
4,621,271 A * 11/1986 Brownstein ..... 347/211
5,754,217 A * 5/1998 Allen ..... 347/239
5,986,688 A * 11/1999 Schaaf ..... 347/252

FOREIGN PATENT DOCUMENTS

JP 10-146996 6/1998
JP 11-254741 9/1999

OTHER PUBLICATIONS

D. E. Hare et al., "New Method for Exposure Threshold Measurement of Laser Thermal Imaging Materials", Journal of Imaging Science and Technology, vol. 41, No. 6 Dec. 1997, pp. 588–593.

* cited by examiner

*Primary Examiner*—Huan Tran
(74) *Attorney, Agent, or Firm*—Sughrue Mion, PLLC

(57) ABSTRACT

An optical recording method in which an effective recording sensitivity in the recording of image information on a photosensitive material is raised, whereby a productivity is enhanced owing to lowered energy (laser power) required for the recording or a heightened recording speed. An image is recorded by projecting a light beam onto the photosensitive material formed on a base material backing. The optical recording method includes the steps of: (a) successively outputting pulse light whose duty factor is at most 50%, from a light source; (b) modulating the pulse light output from the light source, in accordance with an image signal, and then projecting the modulated pulse light onto the photosensitive material; and (c) recording the image by causing the pulse light to scan the photosensitive material.

20 Claims, 15 Drawing Sheets

OPTICAL RECORDING METHOD, APPARATUS, SYSTEM AND MEDIUM USING HIGH-POWER LASER LIGHT

CROSS REFERENCE TO RELATED APPLICATION

The present application is a Continuation-In-Part of U.S. patent application Ser. No. 09/848,325 filed on May 4, 2001; now abandoned the disclosure of that application is incorporated herein by reference.

BACKGROUND OF THE INVENTION

1. Field of the Invention

The present invention relates to an optical recording method in which an image is recorded on, for example, a plate for lithography or lithoprinting by directly irradiating the plate with high-power laser light, and also relates to an optical recording apparatus, an optical recording system and an optical recording medium to be used for conducting such an optical recording method.

2. Description of a Related Art

With a CTP (Computer to Plate) or CTC (Computer to Cylinder) plate making system in the field of printing, a plate is fabricated in such a way that image information accumulated in a computer is recorded on a photosensitive plate material (sensitized material) by using a laser scanner or the like, and that the recorded image is developed. According to the system, intermediate printing films for respective colors in a conventional photoengraving process are dispensed with. Therefore, the system is in the limelight as one having the advantages of cost curtailment, rapid processing, quality enhancement, etc.

In that depiction of the CTP or CTC plate making system which employs laser light on the basis of light-to-heat conversion, the sensitivity of the sensitized material is low to lower a depicting speed, and hence, the light of high power needs to be used for the recording. Therefore, the sensitized material has been chiefly submitted to parallel depiction by using a sensitized material mounting/recording system of outer drum type in which a plate with the sensitized material deposited on a base material backing is wound outside a drum, and by employing a laser array which includes several tens semiconductor lasers of watt class.

Such a recording system utilizing the light-to-heat conversion, however, has had the disadvantage that, since heat radiates to an ambient medium, lowering in an effective recording sensitivity is oftener incurred due to thermal diffusion as the recording is done more slowly by the parallel depiction. This phenomenon is called the "low illuminance failure", and is detailed in Hare et al. "New Method for Exposure Threshold Measurement of Laser Thermal Imaging Materials", Journal of Imaging Science and Technology Vol. 41, No. 6, November/December 1997, p588–593. Especially in case of employing aluminum which is common as a material of the base material backing, the thermal diffusion is heavy, so that the recording sensitivity has lowered conspicuously. Another evil effect has been that the recorded image is obscured by the thermal diffusion.

With the intention of improving the drawbacks, Japanese Patent Application Laid-open JP-A-10-146996 discloses a method wherein the effective recording sensitivity is raised by heightening the scanning speed of a laser beam.

Besides, Japanese Patent Application Laid-open JP-A-11-254741 discloses a method wherein the shape of a laser beam on the sensitized material is narrowed in a main scanning direction into a flat shape, thereby to shorten the projection time of the laser beam at each point on the surface of the sensitized material and to raise the effective recording sensitivity.

Meanwhile, the sensitized material has also been submitted to the depiction by using a sensitized material mounting/recording system of inner drum type in which the plate with the sensitized material deposited on a base material backing is wound inside a drum, and by employing a YAG (Yttrium Aluminum Garnet) laser which continuously oscillates at a high power of about 10 watts or above. In this case, an image is recorded by combining an external modulator such as AOM (Acousto-Optic Modulator), and the scanning of a laser beam based on a high-speed rotating mirror. According to such a sensitized material mounting/recording system of the inner drum type, the effective recording sensitivity can be raised by shortening the projection time of the laser beam at each point on the surface of the sensitized material. However, the rise of the sensitivity is an effect derived from the necessity of recording the image at high speed by employing the single light source, and still more rise in the sensitivity has not been realized.

Therefore, further rise in the recording sensitivity is desired even when the techniques of the improvements in the sensitized material mounting/recording systems of the inner drum type and the outer drum type as explained above are employed.

SUMMARY OF THE INVENTION

The present invention has been made in view of such problems. A first object of the present invention is to raise an effective recording sensitivity in the recording of image information on a photosensitive material, whereby a productivity is enhanced owing to lowered energy (laser power) necessary for the recording or a heightened recording speed. Besides, a second object of the present invention is to improve the evil effect that a recorded image is obscured due to thermal diffusion, whereby the sharpness of the recorded image is enhanced.

In order to accomplish the objects, an optical recording method according to the present invention, wherein an image is recorded by projecting a light beam onto a photosensitive material formed on a base material backing, comprises the steps of: (a) successively outputting pulse light having a duty factor of at most 50%, from a light source; (b) modulating the pulse light output from the light source, in accordance with an image signal, and then projecting the modulated pulse light onto the photosensitive material; and (c) recording the image by causing the pulse light to scan the photosensitive material.

Besides, an optical recording apparatus according to the present invention, wherein an image is recorded by projecting a light beam onto a photosensitive material formed on a base material backing, comprises: a light source for successively outputting pulse light having a duty factor of at most 50%; modulation means for modulating the pulse light output from the light source, in accordance with an image signal, and then projecting the modulated pulse light onto the photosensitive material; and scanning means for causing the pulse light to scan the photosensitive material, thereby to record the image.

Further, an optical recording system according to the present invention comprising: an optical recording medium including a photosensitive layer formed on a base material backing, the photosensitive layer including a photosensitive material for recording an image when a light beam is projected thereon and having a thickness of at most 15 nm; a light source for successively outputting pulse light having a duty factor of at most 50%; modulation means for modulating the pulse light output from the light source, in accordance with an image signal, and then projecting the modulated pulse light onto the photosensitive layer; and scanning means for causing the pulse light to scan the photosensitive layer, thereby to record the image.

In addition, an optical recording medium according to the present invention comprising: a base material backing; and a photosensitive layer formed on the base material backing, the photosensitive layer including a photosensitive material for recording an image when a light beam is projected thereon and having a thickness of at most 15 nm.

According to the present invention constructed as described above, an image is recorded using pulse light having a duty factor of 50% or below, whereby an effective recording sensitivity in optical recording can be enhanced. It is accordingly permitted to lower total energy necessary for the recording or to enhance the productivity by heightening a recording speed. Further, the energy for the recording is lowered, whereby the obscurity of the recorded image attributed to thermal diffusion can be improved to enhance the sharpness thereof.

DESCRIPTION OF THE PREFERRED EMBODIMENTS

Figure 1:
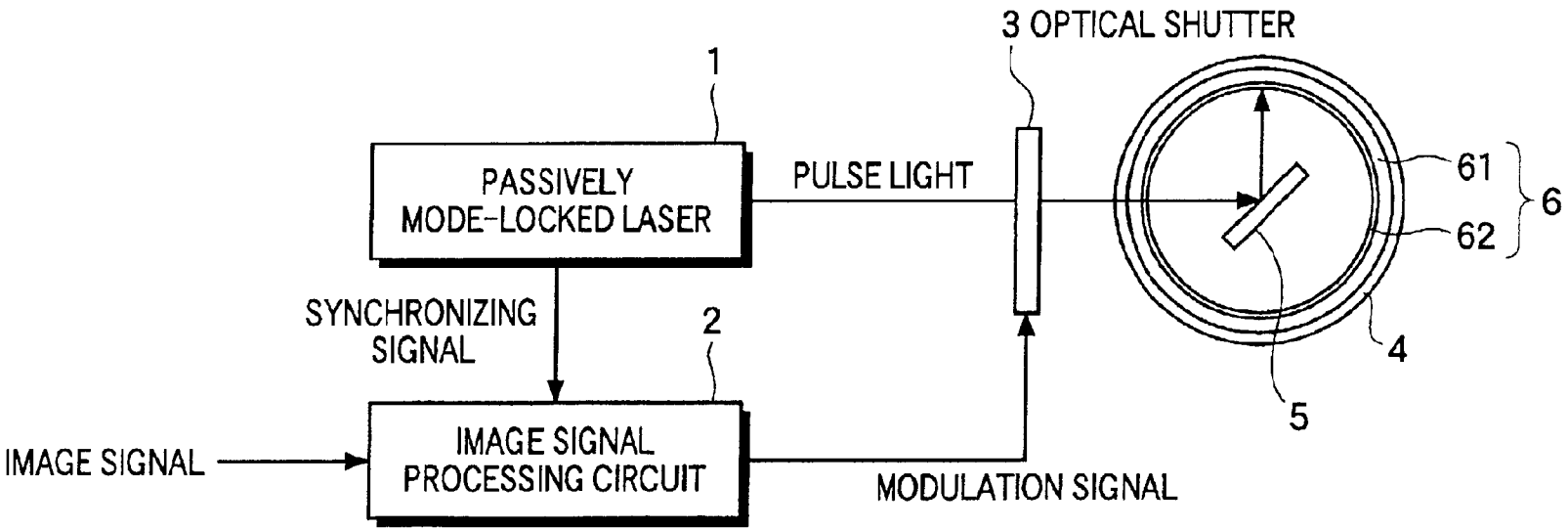
FIG. 1 is a diagram schematically showing an optical recording apparatus according to a first embodiment of the present invention.

Now, embodiments of the present invention will be described in detail with reference to the drawings. By the way, identical constituents shall be indicated by the same reference numerals and the description thereof shall be omitted.

FIG. 1 is a diagram schematically showing an optical recording apparatus according to the first embodiment of the present invention. The optical recording apparatus includes a passively mode-locked laser 1 for generating pulsed laser light. A synchronizing signal synchronous with each pulse light is derived from the passively mode-locked laser 1, and is applied to an image signal processing circuit 2. The image signal processing circuit 2 creates a modulation signal for modulating the pulse light, on the basis of an image signal, and feeds the modulation signal to an optical shutter 3 in synchronism with the synchronizing signal. The optical shutter 3 modulates the pulse light generated by the passively mode-locked laser 1, in accordance with the fed modulation signal.

The pulse light modulated by the optical shutter 3 is reflected by a rotating mirror 5 disposed inside a drum 4, and the reflected light irradiates a plate 6, as an optical recording medium, wound on the inner surface of the drum 4. The plate 6 includes a base material backing (substrate) 61 and a sensitized material (photosensitive layer) 62 which is formed on the substrate 61. The photosensitive layer 62 may well be further overlaid with an overcoat layer (cover layer). An image is recorded in such a way that the reflected light scans the surface of the photosensitive layer 62 by rotating the rotating mirror 5 at a predetermined rotational frequency.

Figure 2:
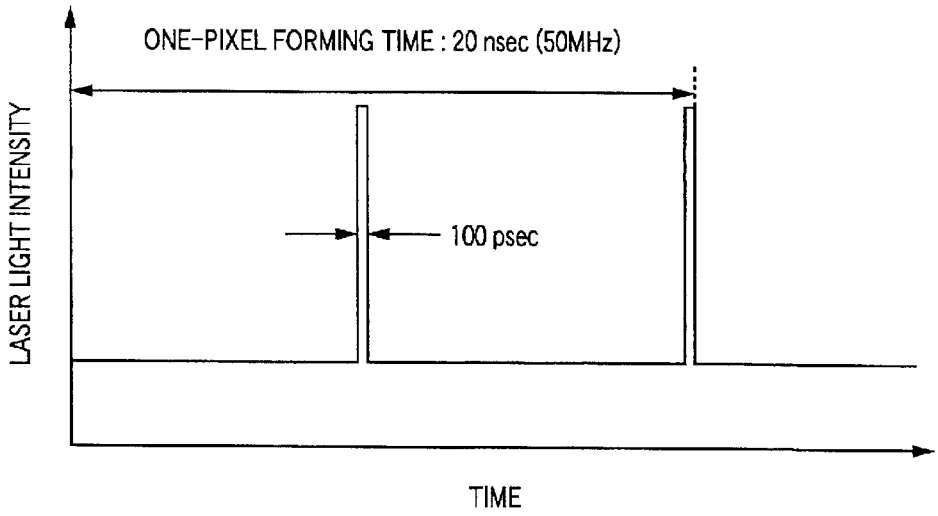
FIG. 2 is a graph showing the waveform of pulsed laser light which is emitted from a passively mode-locked laser shown in FIG. 1.

Shown in FIG. 2 is the waveform of the pulsed laser light which is emitted from the passively mode-locked laser. In order to shorten the recording time of the whole image, a recording time per pixel (hereinbelow, termed the "one-pixel forming time" is desirably set at 1 $\mu$sec or below. More preferably, the one-pixel forming time is set at 200 nsec or below. In this embodiment, the one-pixel forming time is set at 20 nsec (50 MHz in terms of frequency). By the way, in a case where only the two gradations of "1" and "0" exist in each pixel, the recording information of one pixel corresponds to one bit of the image signal.

Heretofore, laser light has been continuously projected throughout the one-pixel forming time. In contrast, according to the present invention, short-pulse light having a duty factor of 50% or below is employed for the optical recording in order to reduce the total power of the laser and to enhance an effective recording sensitivity in the recording. The short-pulse light may include either a single light pulse output from a single laser, or a plurality of light pulses output from a plurality of lasers arrayed in a predetermined direction. Besides, the number of laser pulses in the period for recording one pixel may be either one or larger. By way of example, in the case where the one-pixel forming time is 20 nsec, the exposure of the plate may be made using one laser pulse whose pulse width is 10 nsec, or it may well be made using two laser pulses by turning ON/OFF the laser light at a pulse width of 5 nsec twice.

When the laser light is projected in pulsed fashion in this manner, the total power of the laser can be reduced. As a result, it is permitted to use a laser whose rated output is lower than in the prior art. The reason therefor is that, since the rated output of a laser is chiefly determined by the steady output power thereof, the momentary output of the laser can be made higher than the rated output thereof by diminishing the duty factor of pulse light. By way of example, when the duty factor of the laser light is set at 50%, theoretically the momentary output of the laser can be made about double the rated output. Meanwhile, the effective recording sensitivity in the optical recording is improved by shortening the projection time of the laser light (the time of the exposure) for each pixel as explained before. For such reasons, it is efficient to employ the pulse light in the optical recording of image information.

The passively mode-locked laser is capable of generating short-pulse light having duration of several picoseconds to one nanosecond. With the intention of more heightening the effective recording sensitivity in the optical recording, it is considered to make the duty factor of the laser light still smaller by utilizing the laser operation. By way of example, the projection period of a laser pulse is set at 200 psec (1% of the one-pixel forming time of 20 nsec) or below, and the duty factor of the laser light is set at 1% or below. In this embodiment, the projection period of the laser pulses during the one-pixel forming time is set at (100 psec×2), so that the laser pulses having the duty factor of 1% are employed.

Figure 3:
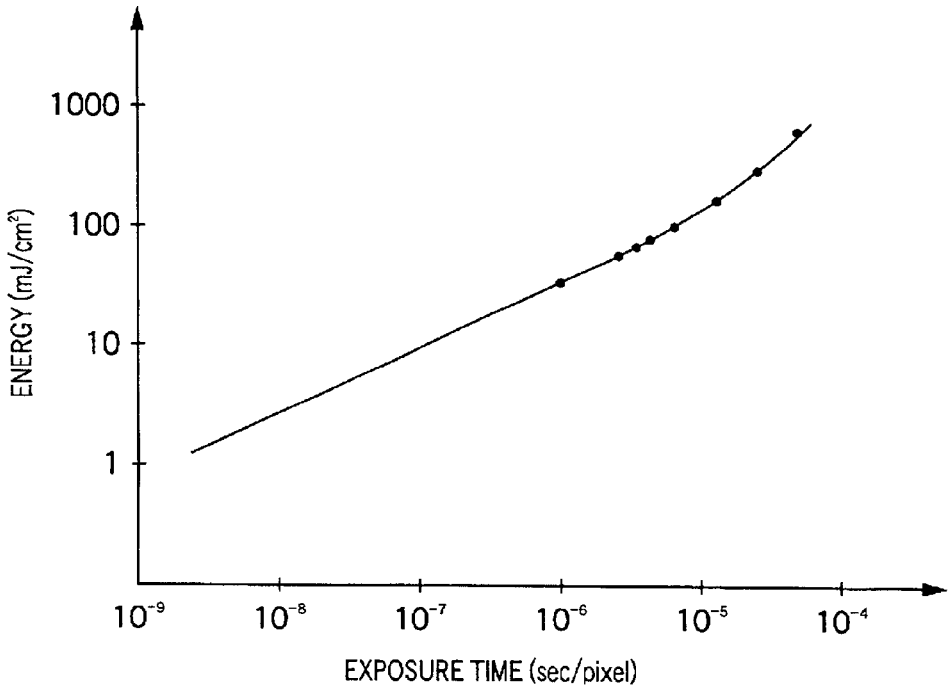
FIG. 3 is a graph showing the measured values of the minimum energy levels required for respective exposure times.

In order to demonstrate that the effective recording sensitivity in the optical recording changes depending upon the exposure time, optical recording operations were carried out with the exposure time varied, and the minimum required energy levels were measured at the respective exposure times. The results obtained are shown in FIG. 3. FIG. 3 shows the minimum energy levels (in $mJ/cm^2$) required for the respective exposure times (in seconds/pixel). Incidentally, the effective recording sensitivity in the optical recording is inversely proportional to the value of the minimum required energy.

In the measurement, a CTP plate "LH-P1" produced by Fuji Photo Film Co., Ltd. (in Japan) was used. A sensitized material employed for the plate is a positive photosensitive composition for an infrared laser. The composition contains a substance which absorbs light to generate heat, and a resin which is soluble in an alkali aqueous solution and which has a phenolic hydroxyl group. It has the property that the heated parts thereof turn soluble in the alkali aqueous solution. In addition, an aluminum plate whose surface is roughened is employed as the base material backing of the CTP plate.

Besides, in the measurement, image-developing processes are performed after the exposure of the sensitized material. An image formed in the surface of the sensitized material at the exposure is stably fixed by performing such chemical processes after the exposure. The image developing processes were carried out with an automatic developing machine "LP-900H" having immersion type developing tanks and manufactured by Fuji Photo Film Co., Ltd. They will be outlined below.

Initially, the first process is implemented in such a way that 20 liters of alkali developing-process solution are poured into the first process tank (developing process tank) of the automatic developing machine "LP-900H" and are held at a temperature of 30° C., and that the plate including the sensitized material is immersed in the solution for about 14 seconds. The alkali developing-process solution contains 2.5 weight-% of D-sorbite, 0.85 weight-% of sodium hydroxide, 0.05 weight-% of diethylenetriamine-penta (methylenephosphonic acid) pentasodium salt and 96.6 weight-% of water, and it has a pH-value of about 13.

Subsequently, the second process is implemented in such a way that 8 liters of water are poured into the second process tank of the automatic developing machine "LP-900H", and that the plate including the sensitized material is immersed in the water. Further, the third process is implemented in such a way that a rinsing solution "FP-2W" produced by Fuji Photo Film Co., Ltd. is diluted with water at 1:1 and is poured into the third process tank of the automatic developing machine "LP-900H", and that the plate including the sensitized material is immersed in the diluted rinsing solution.

Figure 5:
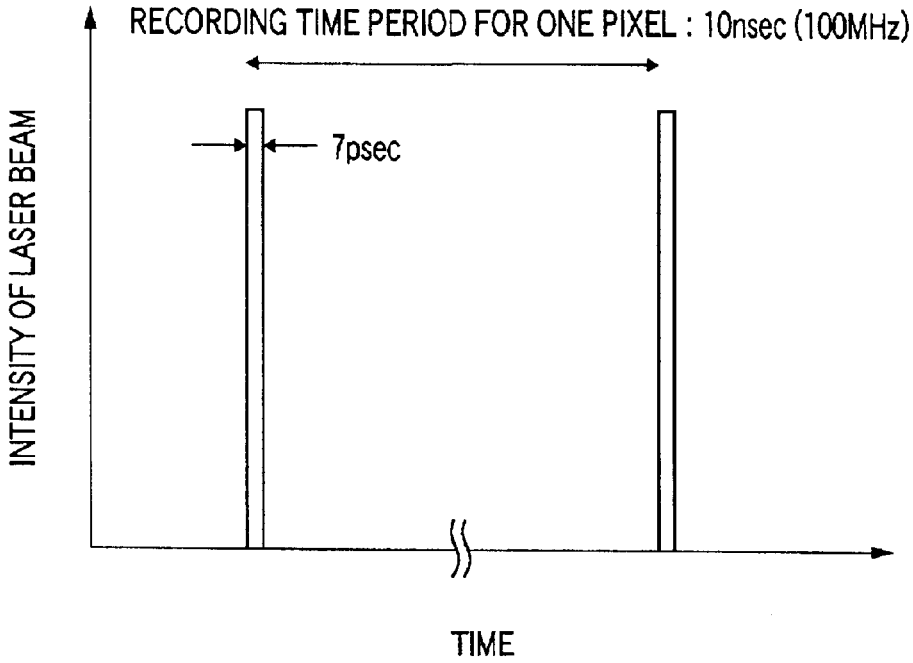
FIG. 5 is a diagram showing a waveform of pulsed laser light used in a simulation about an optical recording system according to one embodiment of the present invention.

As shown in FIG. 3, the required energy is lower as the exposure time is shorter. This tendency is also indicated in Hare et al. "New Method for Exposure Threshold Measurement of Laser Thermal Imaging Materials" cited before (FIG. 5 on page 592 of Hare et al.). The paper, however, reveals that the rise of the sensitivity (the decrease of the energy) tends to be saturated at an exposure time on the order of $10^{-7}$ sec.

In Hare et al., thermal imaging materials produced by Presstek, Inc. have been subjected to exposure, and only physical phenomena have been observed without developing images. In contrast, in the measured results as shown in FIG. 3, not only the physical phenomena, but also the chemical phenomena of the image developing processes intervene, and the rise of the sensitivity (the decrease of the energy) is considered to continue down to a still shorter exposure time on the order of $10^{-9}$ sec. This is so interpreted that, since light is more absorbed nearer to the surface of the photosensitive layer and is diffused less at the surface of the photosensitive layer at the exposure step, an image will be finally fixed by any chemical reaction at the subsequent development step even with the shorter exposure.

Various mechanisms are included in the rises of the effective recording sensitivity based on shortening the exposure time in this manner, and any of them may be utilized in the present invention. In, for example, a CTP plate which employs thermal mode recording for a sensitized material formed on a metal substrate, the influence of thermal diffusion is inevitable even when a heat insulating layer is formed on the substrate, so that the rise of the effective recording sensitivity is attained by shortened pulses.

Figure 4:
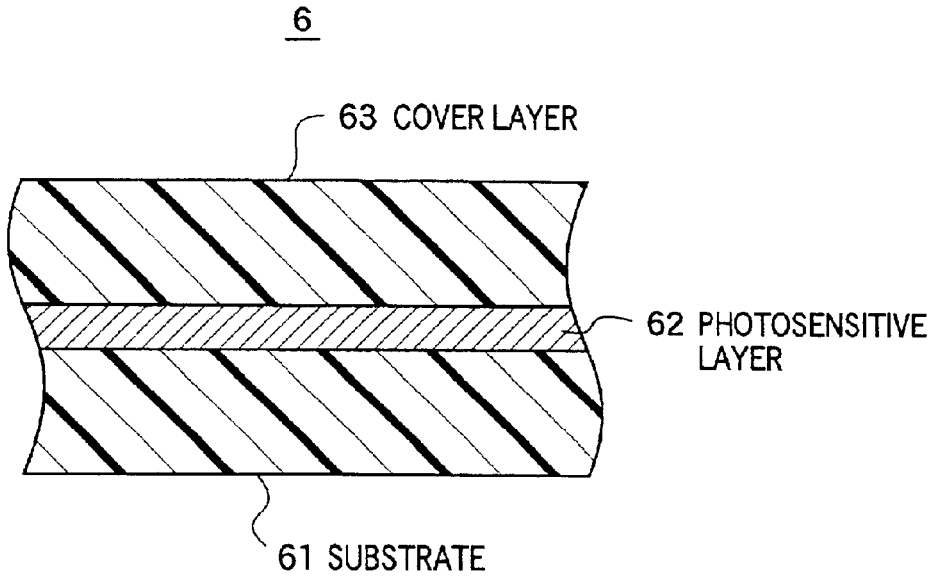
FIG. 4 is a sectional view, on enlarged scale, showing an optical recording medium for use in an optical recording system according to one embodiment of the present invention.

FIG. 4 is a sectional view, on enlarged scale, showing a plate which is an optical recording medium for use in an optical recording system according to this embodiment. The plate 6 is formed such that a substrate 61 is overlaid with a photosensitive layer 62 which has a thickness of 1 nm to 15 nm, more preferably 5 nm to 10 nm. Usable as a material of the substrate 61 is a metal such as aluminum (thermal conductivity: 2.37 J/sec·cm·K), or a synthetic resin such as PET (polyethylene terephthalate, thermal conductivity: 0.0028 J/sec·cm·K). The photosensitive layer 62 may well be further overlaid with a cover layer 63 made of PET or the like, for the purposes of heat insulation and protection.

Generally, in a case where the total quantity of a sensitized material is large, sensitivity is controlled by quantity of the sensitized material. By way of example, in recording based on a thermal mode, energy necessary for heating the sensitized material becomes much, so that the sensitivity is governed by the quantify of the sensitized material. In the present invention, therefore, the effective utilization of absorbed light energy is achieved by making the photosensitive layer as an ultra-thin film.

Prior-art thermal recording has been performed in such a way that the quantity of exposure energy is set large by employing long pulse light on the order of several hundred nanoseconds (nsec) to 10 μsec, and that a time period of at least 50%, usually at least 90%, is expended with respect to the maximum time period necessary for recording per pixel. When a photosensitive layer is heated for such a long time period, energy is heavily lost especially by thermal diffusion which takes place after the conversion of the pulse light into heat. Accordingly, even when energy for heating the photosensitive layer is suppressed by thinning this photosensitive layer, the energy loss ascribable to the thermal diffusion occurs in excess of a suppressed component, and hence, the effect based on the thinning of the photosensitive layer is slight.

In contrast, when an exposure time period is shortened by employing short pulse light as in the optical recording system according to this embodiment, thermal diffusion which takes place after the conversion of the pulse light into heat is decreased down to a negligible degree, and hence, the effect of suppressing energy necessary for heating the photosensitive layer becomes remarkable by thinning the photosensitive layer. This effect can be verified as long as the photosensitive layer has a thickness of a diatomic layer or so (about 1 nm thick). However, considering an abrasion resistance as a CTP plate, the photosensitive layer will require a thickness of about 5 nm.

A heating simulation was carried out by employing the plate 6 which included the substrate 61, photosensitive layer 62 and cover layer 63 as shown in FIG. 4, and while the thickness of the photosensitive layer 62 was changed. In the simulation, the photosensitive layer 62 was made of metal titanium, and the thickness thereof was changed within a range of 3 nm to 30 nm inclusive. Besides, the substrate 61 was made of PET (thermal conductivity: 0.0028 J/sec·cm·K). Further, the cover layer 63 made of PET was disposed on the photosensitive layer 62 in order to insulate heat. The highest temperature which the sensitized material would reach was calculated under the following two different conditions of irradiating laser pulses, under the assumption that 50% of irradiating laser light would be absorbed by the photosensitive layer.

(1) Long pulse width exposure (power density of 30 $kW/cm^2$, pulse width of 7 μsec.)

(2) Short pulse width exposure (power density of 30 $GW/cm^2$, pulse width of 7 psec.)

Here, the total quantity of energy of one laser pulse was constant. FIG. 5 shows a waveform of pulsed laser light in the irradiating condition (2).

Figure 6:
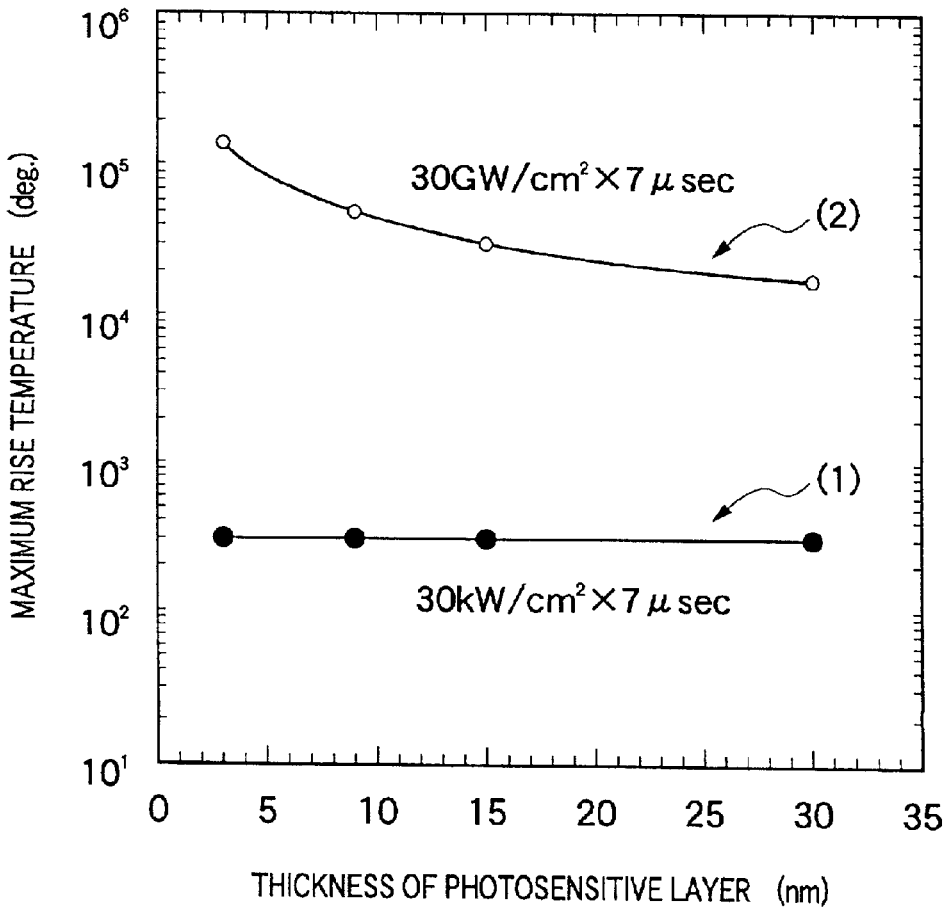
FIG. 6 is a diagram showing a result of the simulation about an optical recording system according to one embodiment of the present invention.

The results of the simulation are shown in FIG. 6. In FIG. 6, the axis of abscissas represents the thickness of the photosensitive layer, while the axis of ordinates represents the maximum rise temperature of the photosensitive layer.

As shown in FIG. 6, in the case of the long pulse width exposure of the irradiating condition (1), the rise temperature is substantially constant without depending upon the thickness of the photosensitive layer. The reason therefor is that, not only the photosensitive layer, but also the surrounding layers are heated by the diffusion of heat.

In contrast, in the case of the short pulse width exposure of the irradiating condition (2), high temperatures exceeding $10^4$ degrees (° C.) are attained irrespective of the thickness of the photosensitive layer, and the temperature rises more as the thickness of the photosensitive layer is smaller. This tendency is marked in a range in which the thickness of the photosensitive layer is not greater than 15 nm. Especially in a range in which the thickness of the photosensitive layer is not greater than 10 nm, a temperature rise observed is about 1.5 times to about 9 times greater than in the case where the thickness is 30 nm. Considered as the reason for the greater temperature rise is that, in the short pulse width exposure, the energy loss ascribable to the thermal diffusion will be little influential, so the heat capacity of the photosensitive layer itself will be decreased by decreasing the thickness of the photosensitive layer.

Figure 7:
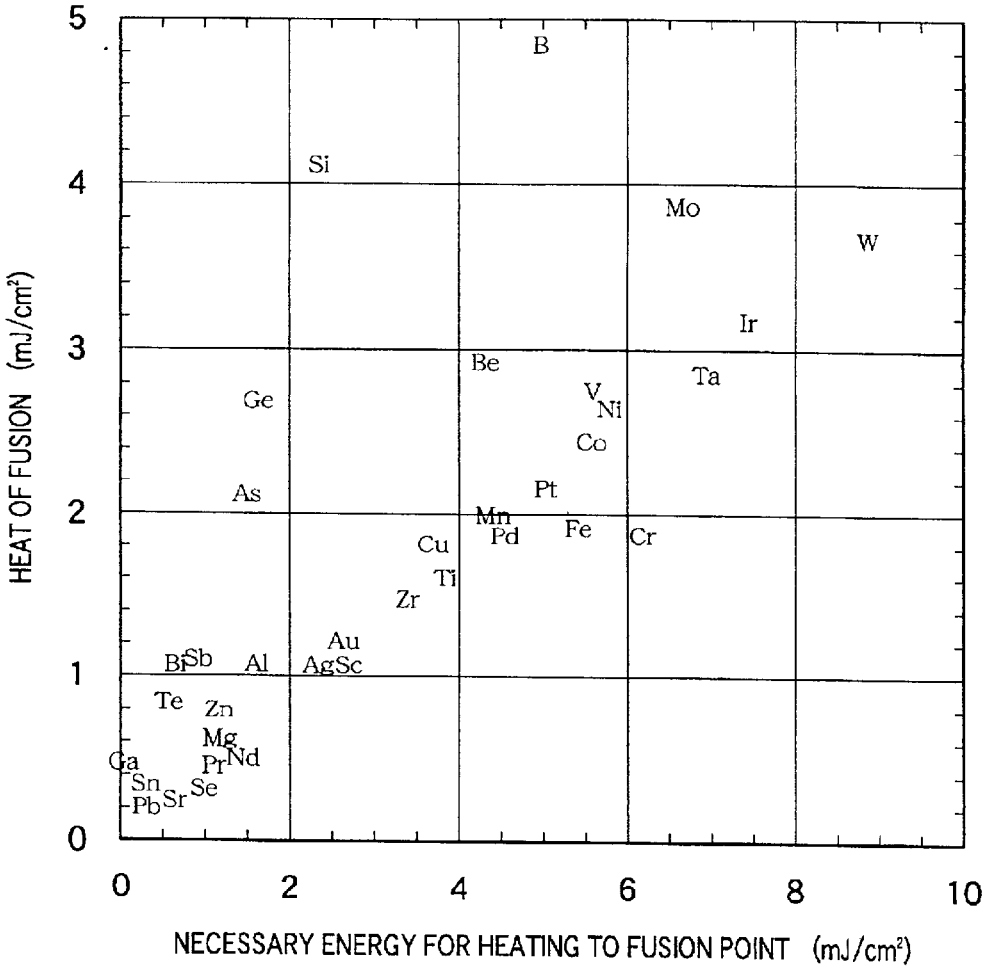
FIG. 7 is a diagram showing a relationship between energy necessary for a temperature rise to a fusing point and the heat of fusion, as to each of thin films of various metals.

Shown in FIG. 7 is the relationship between energy necessary for a temperature rise to a fusing point and the heat of fusion, as to each of thin films of various metals being 10 nm thick. The axis of abscissas represents the energy per unit area, necessary for heating to the fusing point, while the axis of ordinates represents the heat of fusion per unit area.

Energy for heating a metal, which is a material of a photosensitive layer, to a fusing point and for fusing the metal is required for recording in, for example, an ablation mode in printing. As shown in FIG. 7, the energy suffices with a quantity not larger than 10 $mJ/cm^2$ if the thickness of the photosensitive layer is not larger than 10 nm.

Accordingly, when the photosensitive layer thinned down to 10 nm is subjected to the short pulse width exposure, thermal mode recording is realized which has a sensitivity of several $mJ/cm^2$, which is at least one order higher than that in the prior art. By heightening the recording sensitivity in this manner, a recording speed can be enhanced, or an exposing laser of lower energy can be adopted, so that a cost can be lowered.

Although metals are employed as the sensitized material in the above examples, it is also possible to employ oxides or nitrides such as titanium oxide ($TiO_x$) or titanium nitride ($TiN_x$), organic light absorption layers, or the like.

Besides, when the thickness of the photosensitive layer is 10 nm or less, the influence of thermal diffusion in a short time period becomes unnegligible. In such a case, by employing a synthetic resin or the like of low thermal conductivity for the substrate, the thermal diffusion can be suppressed and it becomes possible to efficiently raise the temperature of the sensitized material. Besides the PET, any of various synthetic resin materials can be employed as the synthetic resin for the substrate or the cover layer.

Figure 8:
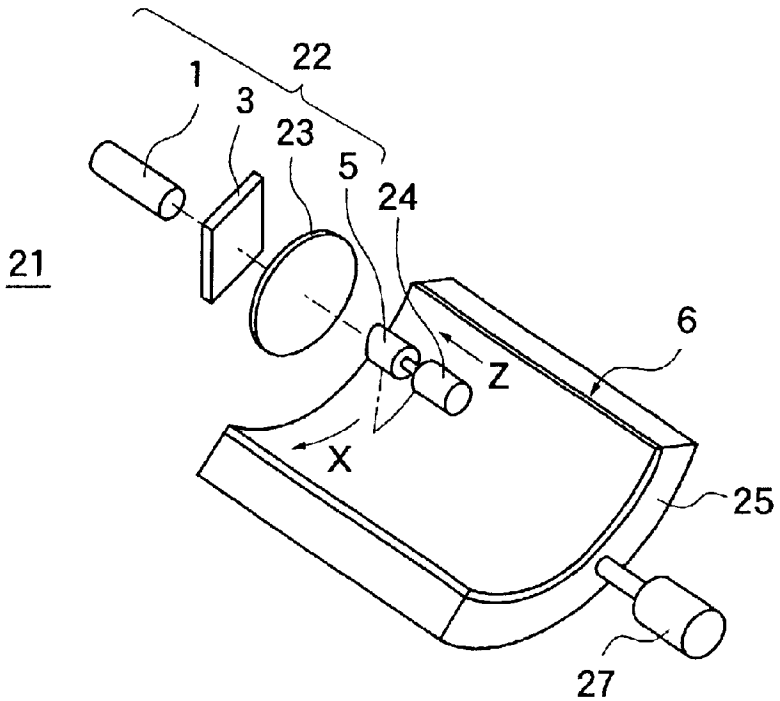
FIG. 8 is a perspective view showing a part of the optical recording apparatus of inner drum type according to the first embodiment of the present invention.
Figure 9:
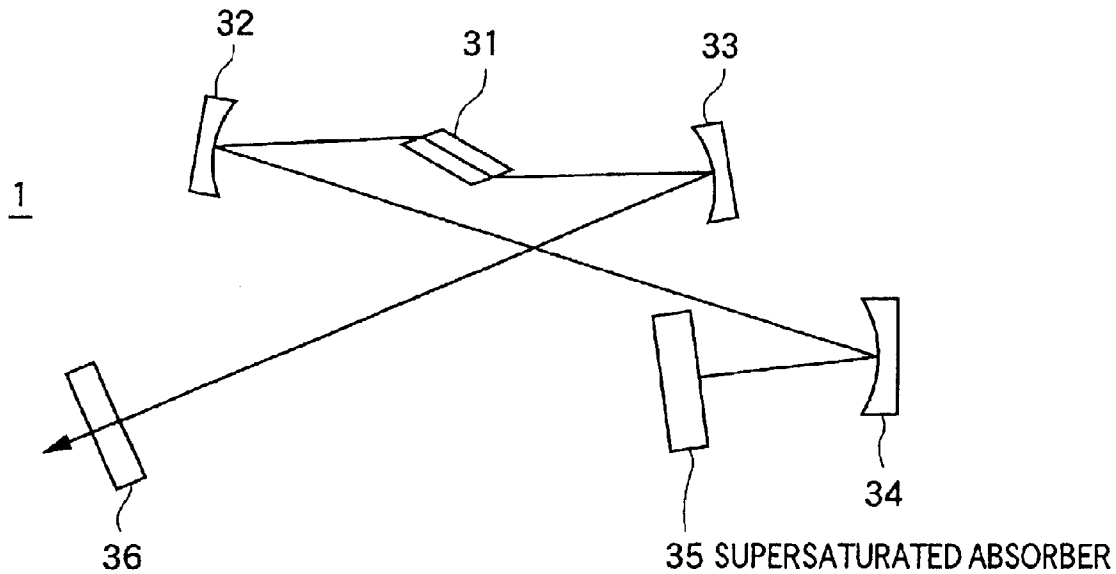
FIG. 9 is a diagram schematically showing the passively mode-locked laser.

Referring now to FIGS. 8 and 9, the optical recording apparatus according to the first embodiment of the present invention will be described in detail.

FIG. 8 is a perspective view showing a part of the optical recording apparatus of inner drum type in this embodiment. The inner drum type optical recording apparatus 21 includes a drum 25 whose inner surface is cylindrical. A plate 6 in which a sensitized material is deposited on a base material backing of aluminum or the like, is fixed inside the drum 25. The drum 25 is driven by a drum moving mechanism 27 so as to move in a direction along the axis of the drum 25 (a Z-direction indicated in FIG. 8).

The optical system 22 of the optical recording apparatus 21 includes a passively mode-locked laser 1, an optical shutter 3 and a rotating mirror 5. Further, a collective lens 23 may well be disposed. Pulse light generated by the passively mode-locked laser 1 is modulated by the optical shutter 3 which is turned ON/OFF (opened/shut) in accordance with an image signal. The pulse light passed through the optical shutter 3 is focused by the collective lens 23. The focal point of the focusing is adjusted so as to lie in the vicinity of the surface of the photosensitive layer of the plate 6.

The pulse light exiting from the collective lens 23 enters the rotating mirror 5. The face of the rotating mirror 5 on the side of the collective lens 23 is inclined by 45° relative to the axis of the optical system 22. The laser light impinging on the face enters the surface of the sensitized material of the plate 6 substantially perpendicularly thereto. The rotating mirror 5 is driven by a motor 24 so as to rotate fast about the same axis as the drum axis. A position within the photosensitive layer on which the laser light impinges is changed by the rotation of the rotating mirror 5, and the laser light scans the surface of the sensitized material in a main scanning direction (an X-direction indicated in FIG. 8). Incidentally, since the plate 6 is moved in the direction along the drum axis (the Z-direction indicated in FIG. 8), the laser light scans the surface of the sensitized material in two dimensions in the main scanning direction and the sub scanning direction.

FIG. 9 is a diagram schematically showing the passively mode-locked laser 1 which is used in the optical recording apparatus in this embodiment. The passively mode-locked laser 1 includes a laser medium 31 which amplifies laser light by utilizing population inversion. Usable as the laser medium 31 is an Nd:YAG medium employing a crystal in which yttrium aluminum garnet ($Y_3Al_5O_{12}$) is doped with neodymium (Nd) as an impurity. Alternatively, an Nd:YLF ($YLiF_4$) medium, an Nd:$YVO_4$ medium, or the like may well be used instead of the Nd:YAG medium.

Two mirrors 32, 33 which reflect the light amplified by the laser medium 31, are located on both the sides of the laser medium 31. Also disposed are a mirror 34 which reflects the light between the mirror 32 and a supersaturated absorber 35, and an emission mirror 36 which reflects a part of the light entered from the mirror 33 and emits the other part thereof. Thus, the passively mode-locked laser 1 oscillates in a plurality of modes employing different frequencies. The supersaturated absorber 35 absorbs a part of the light entered from the mirror 34, thereby to bring the phases of the plurality of oscillation modes into agreement.

Figure 10:
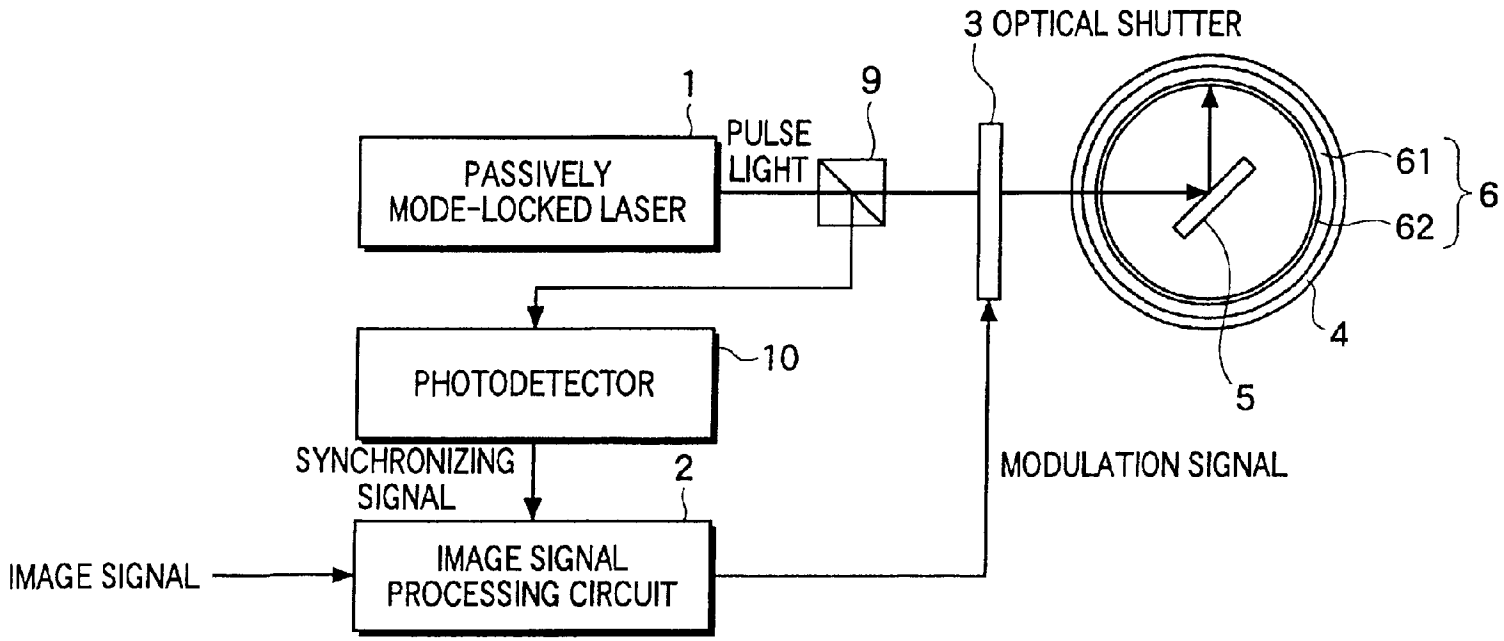
FIG. 10 is a diagram schematically showing an optical recording apparatus according to a second embodiment of the present invention.

Next, an optical recording apparatus according to the second embodiment of the present invention will be described with reference to FIG. 10. FIG. 10 is a diagram schematically showing the optical recording apparatus in the second embodiment of the present invention. In this optical recording apparatus, instead of deriving the synchronizing signal synchronous with each pulse light from the passively mode-locked laser 1 as in the first embodiment, a synchronizing signal is obtained in such a way that the pulse light output from the passively mode-locked laser 1 is split by a beam splitter 9 so as to partly enter a photodetector 10. The other points are the same as in the first embodiment.

Next, an optical recording apparatus according to the third embodiment of the present invention will be described with reference to FIGS. 11 and 12.

Figure 11:
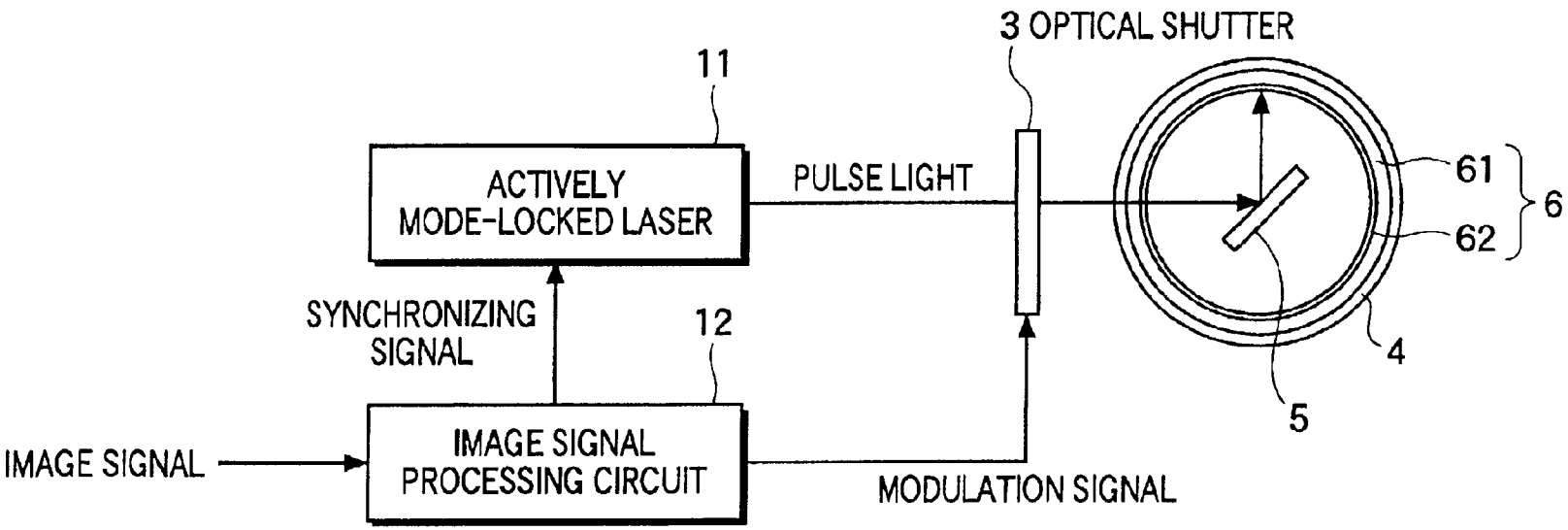
FIG. 11 is a diagram schematically showing an optical recording apparatus according to a third embodiment of the present invention.

FIG. 11 is a diagram schematically showing the optical recording apparatus in the third embodiment of the present invention. This optical recording apparatus employs an actively mode-locked laser 11 instead of the passively mode-locked laser. The actively mode-locked laser 11 can output pulse light in synchronism with a synchronizing signal which is externally applied. Therefore, the pulse light as desired can be obtained by creating the synchronizing signal in an image signal processing circuit 12 and applying it to the actively mode-locked laser 11.

Figure 12:
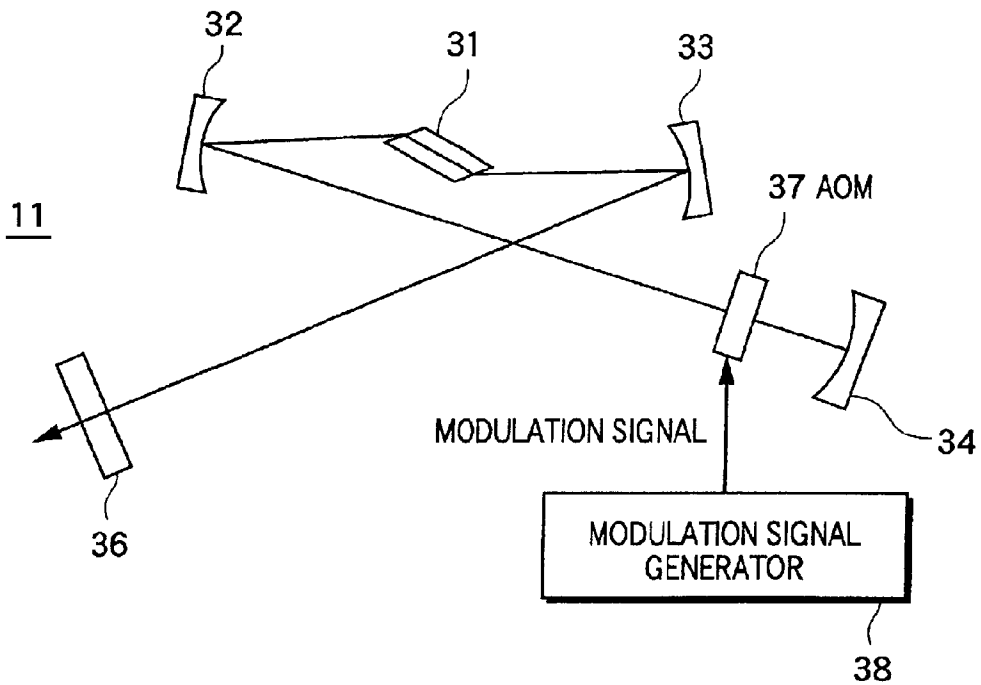
FIG. 12 is a diagram schematically showing an actively mode-locked laser.

FIG. 12 is a diagram schematically showing the actively mode-locked laser which is used in the optical recording apparatus in this embodiment. The actively mode-locked laser 11 employs, for example, an Nd:YAG medium as a laser medium 31. Two mirrors 32, 33 which reflect the light amplified by the laser medium 31, are located on both the sides of the laser medium 31. Also disposed are a mirror 34 which reflects light entered through an AOM (Acousto-Optic Modulator) 37 from the mirror 32, and an emission mirror 36 which reflects a part of the light entered from the mirror 33 and emits the other part thereof. Thus, the actively mode-locked laser 11 oscillates in a plurality of modes employing different frequencies. The AOM 37 modulates the entered light in accordance with a modulation signal output from a modulation signal generator 38, thereby to bring the phases of the plurality of oscillation modes into agreement.

Next, an optical recording apparatus according to the fourth embodiment of the present invention will be described with reference to FIGS. 13–15.

Figure 13:
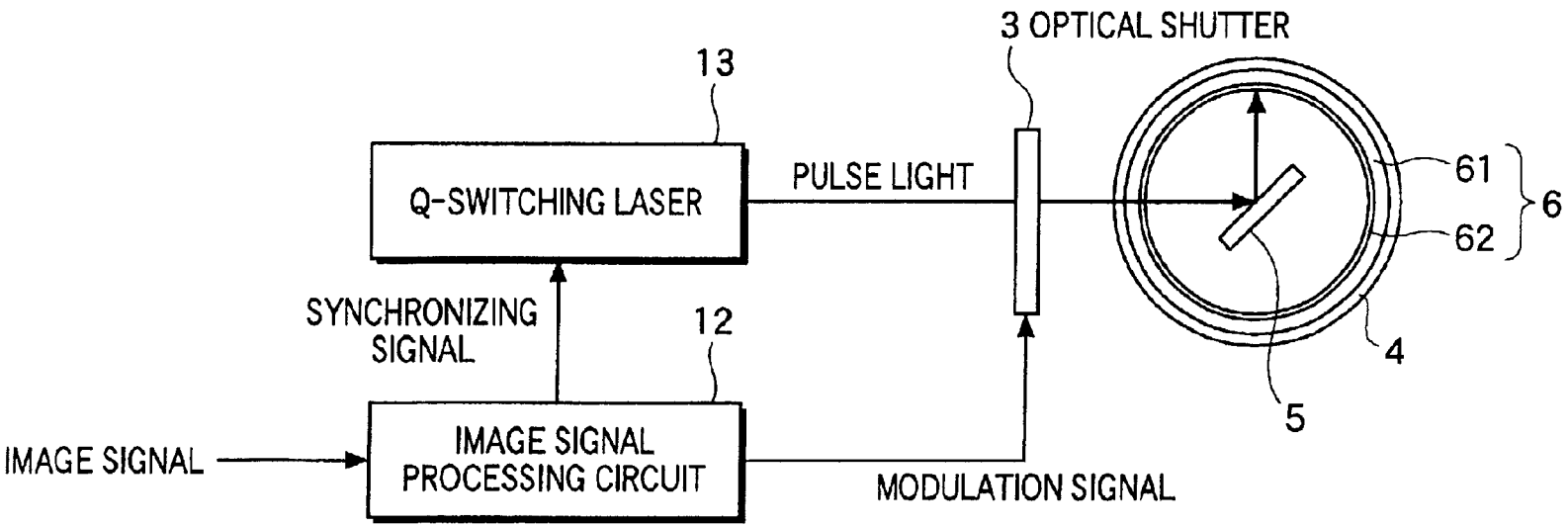
FIG. 13 is a diagram schematically showing an optical recording apparatus according to a fourth embodiment of the present invention.

FIG. 13 is a diagram schematically showing the optical recording apparatus in the fourth embodiment of the present invention. This optical recording apparatus employs a Q-switching laser 13. The Q-switching laser 13 can output pulse light in synchronism with a synchronizing signal which is externally applied. Therefore, the pulse light as desired can be obtained by creating the synchronizing signal in an image signal processing circuit 12 and applying it to the Q-switching laser 13.

Figure 14:
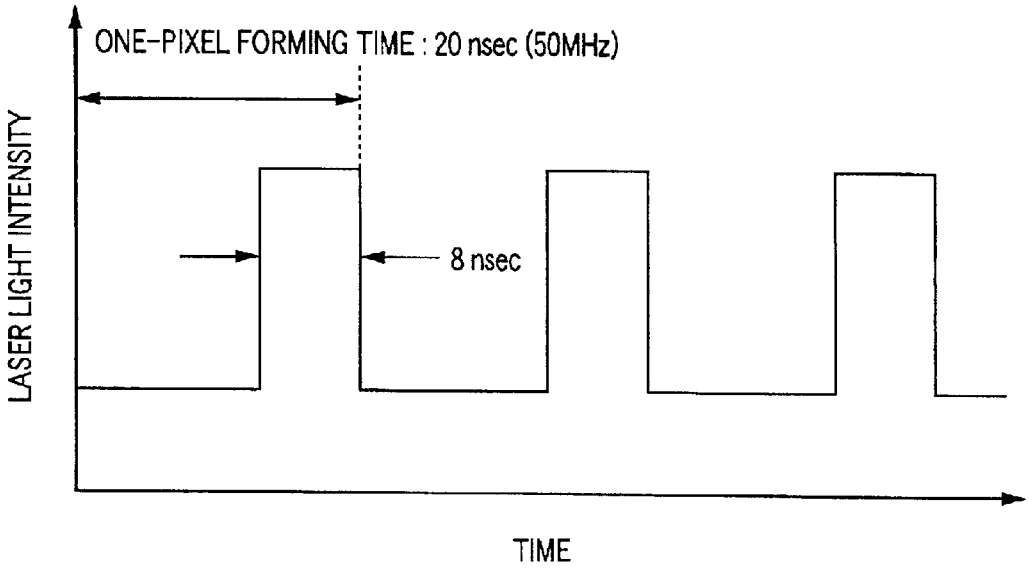
FIG. 14 is a graph showing the waveform of pulsed laser light which is emitted from a Q-switching laser.

Shown in FIG. 14 is the waveform of the pulsed laser light which is emitted from the Q-switching laser 13. A solid state laser or fiber laser based on Q-switching is capable of generating short pulse light of several nanoseconds to several tens nanoseconds. In this embodiment, the projection period of a laser pulse during a one-pixel forming time of 20 nsec is set at 8 nsec, which corresponds to 40% of the one-pixel forming time. Thus, the laser pulses having the duty factor of 40% are employed.

Figure 15:
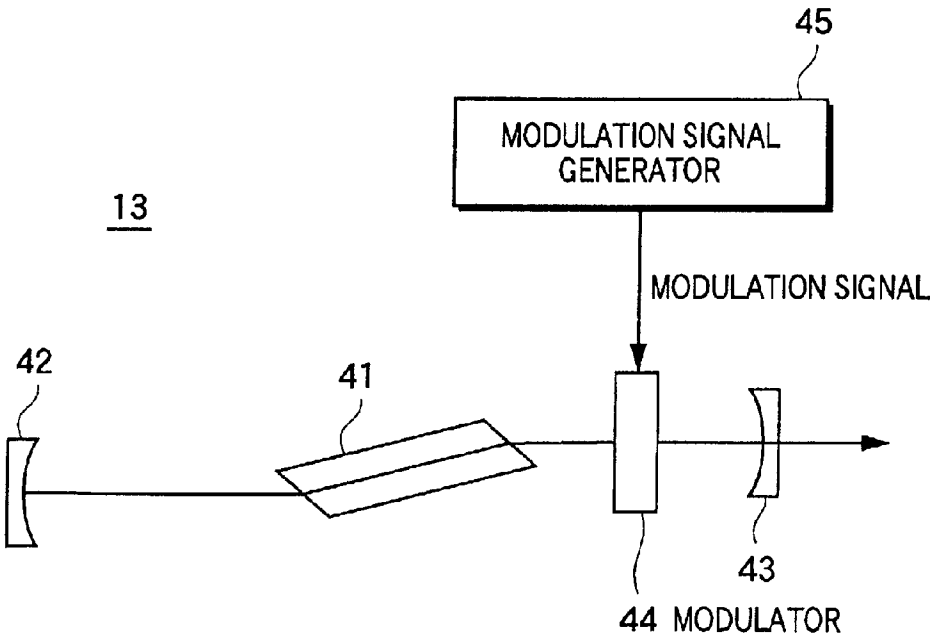
FIG. 15 is a diagram schematically showing the Q-switching laser.

FIG. 15 is a diagram schematically showing the Q-switching laser 13 which is used in the optical recording apparatus in this embodiment. Regarding the laser medium 41 of the Q-switching laser 13, any of various media including an Nd:YAG medium, an Nd:YLF medium, an Nd:$YVO_4$ medium, etc. can be used as a solid-state laser medium. A total reflection mirror 42 and a partial reflection mirror 43 which reflect light amplified by the laser medium 41, are located on both the sides of the laser medium 41. Thus, the Q-switching laser 13 oscillates in a plurality of modes employing different frequencies. Here, a modulator 44 is interposed between the laser medium 41 and the mirror 43 as means for controlling the loss or gain of the laser light. The modulator 44 is constructed of, for example, an AOM (Acousto-Optic Modulator), and it brings the phases of the plurality of oscillation modes into agreement by modulating the entered light in accordance with a modulation signal input from a modulation signal generator 45. Apart from the AOM, any of various modulators such as an EO (Electro-Optic) modulator can be used as the modulator 44.

In the same arrangement, it is also possible to apply the fiber laser which employs an optical fiber doped with Nd, Yb (ytterbium) or the like as a laser medium. Further, it is also allowed to use a gain-switching laser which employs a semiconductor as gain control means. An ordinary semiconductor laser of current injection type is capable of generating pulse light on the basis of gain switching for modulating an injected current. The gain switching laser is capable of generating short pulse light of several tens picoseconds to several nanoseconds.

Figure 16:
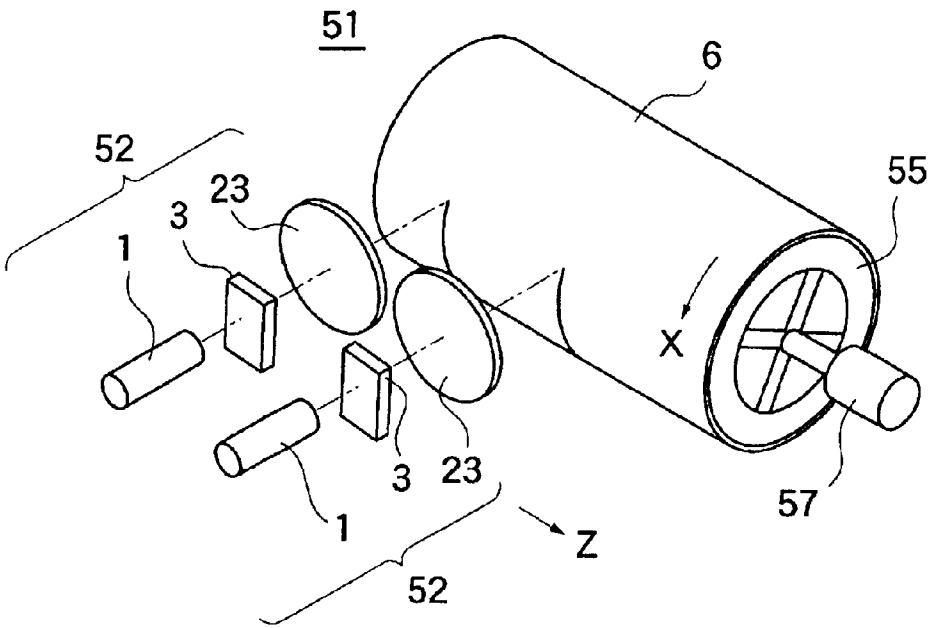
FIG. 16 is a perspective view showing a part of an optical recording apparatus of outer drum type according to a fifth embodiment of the present invention.

Next, an optical recording apparatus according to the fifth embodiment of the present invention will be described with reference to FIG. 16. FIG. 16 is a perspective view showing a part of the optical recording apparatus of outer drum type in this embodiment. In this embodiment, a sensitized material mounting/recording system of the outer drum type is adopted unlike that of the inner drum type as shown in FIG. 8, and the other points are the same as in the foregoing embodiments. Here, an example employing passively mode-locked lasers will be explained.

The optical recording apparatus 51 of the outer drum type includes a drum 55 whose outer surface is cylindrical. A plate 6 in which a sensitized material is deposited on a base material backing of aluminum or the like, is wound outside the drum 55. The drum 55 is driven by a rotating mechanism 57 including a motor, reduction gears, etc., so as to rotate in a direction along the circumference of the drum 55 (an X-direction indicated in FIG. 16).

Each of two optical systems 52 includes the passively mode-locked laser 1, and an optical shutter 3. Further, a collective lens 23 may well be disposed. Pulse light generated by the passively mode-locked laser 1 is modulated by the optical shutter 3 which is turned ON/OFF (opened/shut) in accordance with an image signal. The pulse light passed through the optical shutter 3 is focused by the collective lens 23. The focal point of the focusing is adjusted so as to lie in the vicinity of the surface of the photosensitive layer of the plate 6. The pulse light exiting from the collective lens 23 enters the surface of the photosensitive layer of the plate 6 substantially perpendicularly thereto.

During the recording of an image, the drum 55 is rotated fast in the direction along the circumference thereof (in the X-direction indicated in FIG. 16), while at the same time, the whole optical systems 52 are moved in a direction parallel to the axis of the drum 55 (in a Z-direction indicated in FIG. 16). Accordingly, the laser light two-dimensionally scans the surface of the sensitized material in the main scanning direction and the sub scanning direction. An optical scanner such as polygon mirror or galvano mirror is also usable for the scanning in the Z-direction.

As thus far described, according to the present invention, an image is recorded by employing pulse light having a period of 50% or below of a recording period for one pixel or pulse light having a duty factor of 50% or below, whereby an effective recording sensitivity in optical recording can be enhanced. It is accordingly possible to lower total energy required for the recording. Besides, it is permitted to form the image at high speed owing to the enhancement of the sensitivity, and to shorten a printing process employing a plate on which such an image is recorded. Further, the obscurity of the recorded image attributed to thermal diffusion can be improved to enhance the sharpness thereof by lowering the recording energy.

Moreover, the use of a laser of low rated power is permitted by shaping the laser light into short pulses, so that the cost of a laser light source can be lowered. The generation of the short pulse light by, for example, a passively mode-locked solid state laser or fiber laser can be easily realized by inserting a supersaturated absorber. Accordingly, it is greatly advantageous that the low power laser can be adopted by shaping the laser light into the short pulses.

What is claimed is:

1. An optical recording method for preparation of a plate for printing wherein an image is recorded by projecting a light beam onto a photosensitive material formed on a base material backing, comprising the steps of:

(a) successively outputting pulse light having a duty factor of at most 1%, from a light source;

(b) modulating the pulse light output from the light source, in accordance with an image signal, and then projecting the modulated pulse light onto the photosensitive material; and (c) recording the image by causing said pulse light to scan said photosensitive material.

2. An optical recording method for preparation of a plate for printing wherein an image is recorded by projecting a light beam onto a photosensitive material formed on a base material backing, comprising the steps of:

(a) successively outputting pulse light having a duration of at most 1% in a recording time period assigned for each pixel, from a light source;

(b) modulating the pulse light output from the light source, in accordance with an image signal, and then projecting the modulated pulse light onto the photosensitive material; and (c) recording the image by causing said pulse light to scan said photosensitive material.

3. An optical recording method according to claim 2, wherein step (a) includes outputting a plurality of light pulses in order to record each pixel.

4. An optical recording method according to claim 2, wherein the recording time period assigned for each pixel is at most 1 $\mu$sec.

5. An optical recording method according to claim 2, wherein step (c) includes recording the image onto said photosensitive material by utilizing light-to-heat exchange reaction.

6. An optical recording apparatus for preparation of a plate for printing wherein an image is recorded by projecting a light beam onto a photosensitive material formed on a base material backing, comprising:

a light source for successively outputting pulse light having a duty factor of at most 1%;

modulation means for modulating the pulse light output from said light source, in accordance with an image signal, and then projecting the modulated pulse light onto said photosensitive material; and scanning means for causing said pulse light to scan said photosensitive material, thereby to record the image.

7. An optical recording apparatus for preparation of a plate for printing wherein an image is recorded by projecting a light beam onto a photosensitive material formed on a base material backing, comprising:

a light source for successively outputting pulse light having a duration of at most 1% in a recording time period assigned for each pixel;

modulation means for modulating the pulse light output from said light source, in accordance with an image signal, and then projecting the modulated pulse light onto said photosensitive material; and scanning means for causing said pulse light to scan said photosensitive material, thereby to record the image.

8. An optical recording apparatus according to claim 7, wherein said light source outputs a plurality of light pulses in order to record each pixel.

9. An optical recording apparatus according to claim 7, wherein the recording time period assigned for each pixel is at most 1 $\mu$sec.

10. An optical recording apparatus according to claim 7, wherein said light source includes one of a mode-locked laser, a Q-switching laser and a gain-switching laser.

11. An optical recording apparatus according to claim 10, wherein said mode-locked laser outputs to said modulation means a synchronizing signal which is used in modulating and outputting said pulse light.

12. An optical recording system for preparation of a plate for printing comprising:

an optical recording medium including a photosensitive layer formed on a base material backing, said photosensitive layer including a photosensitive material for recording an image when a light beam is projected thereon and having a thickness of at most 15 nm;

a light source for successively outputting pulse light having a duty factor of at most 1%;

modulation means for modulating the pulse light output from said light source, in accordance with an image signal, and then projecting the modulated pulse light onto said photosensitive layer; and scanning means for causing said pulse light to scan said photosensitive layer, thereby to record the image.

13. An optical recording system for preparation of a plate for printing comprising:

an optical recording medium including a photosensitive layer formed on a base material backing, said photosensitive layer including a photosensitive material for recording an image when a light beam is projected thereon and having a thickness of at most 15 nm;

a light source for successively outputting pulse light having a duration of at most 1% in a recording time period assigned for each pixel;

modulation means for modulating the pulse light output from said light source, in accordance with an image signal, and then projecting the modulated pulse light onto the photosensitive layer; and scanning means for causing said pulse light to scan said photosensitive layer, thereby to record the image.

14. An optical recording system according to claim 13, wherein said light source outputs a plurality of light pulses in order to record each pixel.

15. An optical recording system according to claim 13, wherein the recording time period assigned for each pixel is at most 1 $\mu$sec.

16. An optical recording system according to claim 13, wherein said light source includes one of a mode-locked laser, a Q-switching laser and a gain-switching laser.

17. An optical recording system according to claim 16, wherein said mode-locked laser outputs to said modulation means a synchronizing signal which is used in modulating and outputting said pulse light.

18. An optical recording medium for preparation of a plate for printing comprising:

a base material backing; and a photosensitive layer formed on said base material backing, said photosensitive layer including a photosensitive material for recording an image when a light beam is projected thereon and having a thickness of at most 15 nm, said photosensitive material containing a first material for absorbing light to generate heat and a second material a heated part of which changes its property as to whether it is soluble or not soluble in a particular solution.

19. An optical recording medium according to claim 18, wherein said base material backing is made of a material except for metals.

20. An optical recording medium according to claim 18, wherein said photosensitive material records an image by utilizing light-to-heat exchange reaction.

* * * * *